US006250797B1

(12) United States Patent
Weetman

(10) Patent No.: US 6,250,797 B1
(45) **Date of Patent: *Jun. 26, 2001**

(54) MIXING IMPELLER SYSTEM HAVING BLADES WITH SLOTS EXTENDING ESSENTIALLY ALL THE WAY BETWEEN TIP AND HUB ENDS THEREOF WHICH FACILITATE MASS TRANSFER

(75) Inventor: Ronald J. Weetman, Rochester, NY (US)

(73) Assignee: General Signal Corporation, Muskegon, MI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/164,835

(22) Filed: Oct. 1, 1998

(51) Int. Cl.[7] ..... B01F 7/22

(52) U.S. Cl. ..... 366/270; 366/328.1; 366/330.2; 366/330.3; 261/93; 416/231 B; 416/235

(58) Field of Search ..... 366/102–104, 366/107, 270, 328.1, 330.1–330.7, 348; 416/228, 199, 231 R, 231 A, 231 B, 235, 236 R; 261/93; 422/231

(56) References Cited

U.S. PATENT DOCUMENTS

| | | | | |
|---|---|---|---|---|
| 285,212 | * | 9/1883 | Bell et al. . | |
| 1,135,829 | * | 4/1915 | Macdonald . | |
| 2,003,073 | | 5/1935 | Faber . | |
| 2,045,918 | * | 6/1936 | Moody . | |
| 2,193,686 | * | 3/1940 | Craddock . | |
| 3,044,559 | | 7/1962 | Chajmik . | |
| 3,195,807 | | 7/1965 | Sheets . | |
| 3,865,721 | * | 2/1975 | Kaelin | 261/93 |
| 4,004,786 | * | 1/1977 | Stephens . | |
| 4,102,600 | | 7/1978 | Schwab . | |
| 4,130,381 | | 12/1978 | Levin et al. . | |
| 4,285,637 | | 8/1981 | Thompson . | |
| 4,456,382 | * | 6/1984 | Mahler, II . | |
| 4,468,130 | * | 8/1984 | Weetman | 416/243 |
| 4,519,959 | * | 5/1985 | Takeuchi et al. | 261/93 |
| 4,636,143 | | 1/1987 | Zeides . | |
| 4,882,098 | * | 11/1989 | Weetman | 366/102 |
| 4,896,971 | * | 1/1990 | Weetman et al. | 366/330.1 |
| 4,913,670 | | 4/1990 | Spranger . | |
| 5,046,245 | * | 9/1991 | Weetman et al. . | |
| 5,356,600 | * | 10/1994 | Kiyonaga et al. | 261/93 |
| 5,951,162 | * | 9/1999 | Weetman et al. | 366/328.1 |

* cited by examiner

*Primary Examiner*—Charles E. Cooley
(74) *Attorney, Agent, or Firm*—Pepper Hamilton LLP

(57) ABSTRACT

An axial flow mixing impeller system for efficient mass transfer by control of size of the bubbles of the fluid which is being dispersed, especially gases and liquids with viscosities greater than the liquid into which dispersion occurs, is obtained by creating passageways through the impeller blades for flow between the suction and pressure sides of the blades which disrupts the flow over the suction sides of the blades thereby reducing the tendency for bubbles to grow or coalesce into large bubbles which instead of being dispersed, rise to the surface without effective mass transfer to the liquid which is pumped by the impeller. The blades of the impeller may be slotted inwardly from the tips thereof to provide the passageways or may be formed from segments, gaps between which provide the flow passageways. The segmented blades have the advantage of enabling systems of large diameter impellers, of size approaching the diameter of the tanks or in closed tanks where access is by way of a manway smaller than the impeller blade dimensions, to be assembled within the tank, either upon initial installation or for replacement or retrofit. If the system is not used for gas or liquid dispersion, the segments may be in edge-to-edge abutment. Gas-to-liquid dispersion may also be improved by sparging below the impeller at the bottom of the tank and between the impellers in the tank, as with sparge rings of diameter less than the diameter of the impellers enabling gas supply at different pressures commensurate with the depth of the sparge rings, sufficient to overcome the head at the depth of the sparge ring.

17 Claims, 7 Drawing Sheets

DOWN PUMPING

UP PUMPING

MIXING IMPELLER SYSTEM HAVING BLADES WITH SLOTS EXTENDING ESSENTIALLY ALL THE WAY BETWEEN TIP AND HUB ENDS THEREOF WHICH FACILITATE MASS TRANSFER

The present invention relates to mixing impeller systems, and particularly to axial flow impeller systems.

The invention is especially suitable for providing stirred reactors for gas-to-liquid or liquid-to-liquid dispersion and mass transfer by providing impeller blades which establish clashing or interfering flows of the fluid being pumped with the other fluid (gas or liquid) which is being dispersed or mass transferred into the fluid being pumped. The invention also provides a multiple axial flow impeller system having a series of sparges which introduce the fluid (gas or liquid) being sparged which is delivered to each impeller. The invention is also especially suitable for use in large axial flow impeller systems wherein the impellers are of a size commensurate with the diameter of the tank or the zone between the baffles in the tank in which the impellers rotate or where the tank has limited access, for example, through a manway of size less than the diameter of an impeller or even the width or length of an impeller blade. The blades can be assembled from segments smaller than the diameter of the zones, tanks or size of the manways in the tank. The segments may be assembled leaving gaps which provide flow paths for improving gas dispersion and mass transfer.

Accordingly, it is a feature of the invention to provide improved mixing impeller or agitator system for dispersion and mass transfer in gas-liquid or liquid-liquid systems, also known as stirred reactor systems, wherein bubble growth is controlled thereby improving the performance of the systems and the efficiency of mass transfer, as well as the reduction of undesirable forces and movement of the rotating mechanism which may cause mechanical failures. The growth of bubbles of viscous liquid, especially of viscosity higher than water is inhibited in an impeller system provided in accordance with this feature of the invention.

Another feature of the invention is to provide an improved impeller system which enables use of impellers with large blades, especially impellers for producing axial flow. By large blade is meant a blade which is difficult to install because the size thereof, when assembled into an impeller having a plurality of blades, especially when the assembled impeller is of a diameter commensurate with the diameter of the tank or the zone of the tank in which the impeller is installed. The invention facilitates the installation of large impellers or the replacement of blades or the retrofit of the impellers, for example impellers are the order of 5 to 20 feet in diameter. Many stirred reactors have entrances (called manways) into the tank which do not pass large impeller blades or in which installation and repair or retrofit is difficult due to the space constraints imposed by the size of the tank. The blades may be assembled from segments which can be spaced apart to provide the flow passages for enhanced fluid dispersion for gas-to-liquid and liquid-to-liquid mass transfer. The blade segments are desirably connected at the hub but can be connected at the blade tips, if strengthening is desired.

BACKGROUND OF THE INVENTION

Air moving propellers and turbines have been provided with slots through the blades thereof or assembled with overlapping blades in close proximity. These slots may be formed as scoops to enhance rather than disrupt the flow on the concave or suction side of the propeller or turbine blades to prevent flow separation (sometimes called cavitation). Such propellers or turbines are not used in gas-to-liquid or liquid-to-liquid mass transfer applications. The flow patterns introduced by the slots or gaps in impeller blades provided by the invention are effective to break up bubbles which tend to grow due to the coalescing of the gas or liquid being dispersed on the suction side of the blades thereby enhancing the efficiency of mass transfer and the mass transfer coefficient kLa of the mass transfer process. Propellers, turbines and blades with slots designed to prevent flow separation on the suction side of the blades and multi-blade designs are shown, for example in the following patents: Faber, U.S. Pat. No. 2,003,073, May 28, 1935; Chajmik, U.S. Pat. No. 3,044,559, Jul. 17, 1962; Sheets, U.S. Pat. No. 3,195,807, Jul. 20, 1965; Schaw, U.S. Pat. No. 4,102,600, Jul. 25, 1978; Levin, et al., U.S. Pat. No. 4,130,381, Dec. 19, 1978; Thompson, U.S. Pat. No. 4,285,637, Aug. 25, 1981; Zeides, U.S. Pat. No. 4,636,143, Jan. 13, 1987; Spranger, U.S. Pat. No. 4,913,670, Apr. 3, 1990; Schindling, DE 182,680, Mar. 26, 1907; and a slotted scimitar shaped blade known as the Velmix which has curved slots spaced inwardly from the tips of the blades.

SUMMARY OF THE INVENTION

Accordingly, it is the principal object of the present invention to provide improved mixing impeller systems.

It is a still further object of the present invention to provide improve stirred reactor processes using mixing impellers to disperse and provide mass transfer of a first fluid into a second fluid (gas-to-liquid or liquid-to-liquid) which utilizes axial flow impellers.

It is a still further object of the present invention to provide an improved impeller system having blades assembled from segments which may access the tanks of mixing systems and mixing reactors without interference due to the constraints imposed by tank or manway size, thereby facilitating the installation, replacement or retrofit of impellers having large blades.

It is a still further object of the present invention to provide an improved mixing impeller system wherein gas may be introduced in sparging stages below and between the impellers of the system, thereby enhancing the efficiency of operation of the system.

Briefly, the invention provides a system (method and apparatus) for mass transfer of a first fluid into a second fluid having less density or more viscosity than the first fluid, where the second fluid is released into a tank containing the first fluid from a source thereof or because of a chemical reaction in the tank. The fluids are agitated with an axial flow impeller having a plurality of blades. The blades have suction and pressure sides and tips at the radially outward ends thereof. The size of bubbles on the suction side of the blades are reduced by providing flow pathways for the second fluid through the blades. The pathways extend inwardly from the tips of the blades, and can be generally perpendicular to the suction sides. The pathways can be provided by slots extending from or adjacent to the tips generally radially inward of the blades. The blades may be provided by segments which are assembled to a hub on the shaft which rotates the impeller so as to provide gaps extending generally radially inward from the tips of the blades. The segments may have widths of one-third of one-half the diameter of the impeller, or in any event, sufficient to readily access the tank via a manway or other entryway. The segments may be assembled in the tank and can be butted against each other if flow passways are not needed for the process being carried out in the tank. A multi-impeller system in accordance with the invention has axial flow impellers which are spaced from each other and from the bottom of the tank. Piping is introduced between the lower most impeller and the bottom of the tank and between adjacent impellers to sparge the fluid being dispersed and mixed in a series of stages. The pressure for the lower most sparge piping may be higher than the pressure to the upper sparges, but sufficient to overcome the head in the tank where the sparges are disposed.

The foregoing and other objects, features and advantages of the invention, as well as presently preferred embodiments and the best mode now known for carrying out the invention will become more apparent from a reading of the following description in connection with the drawings, brief descriptions of which are as follows:

DETAILED DESCRIPTION OF THE PREFERRED EMBODIMENTS

Figure 1:
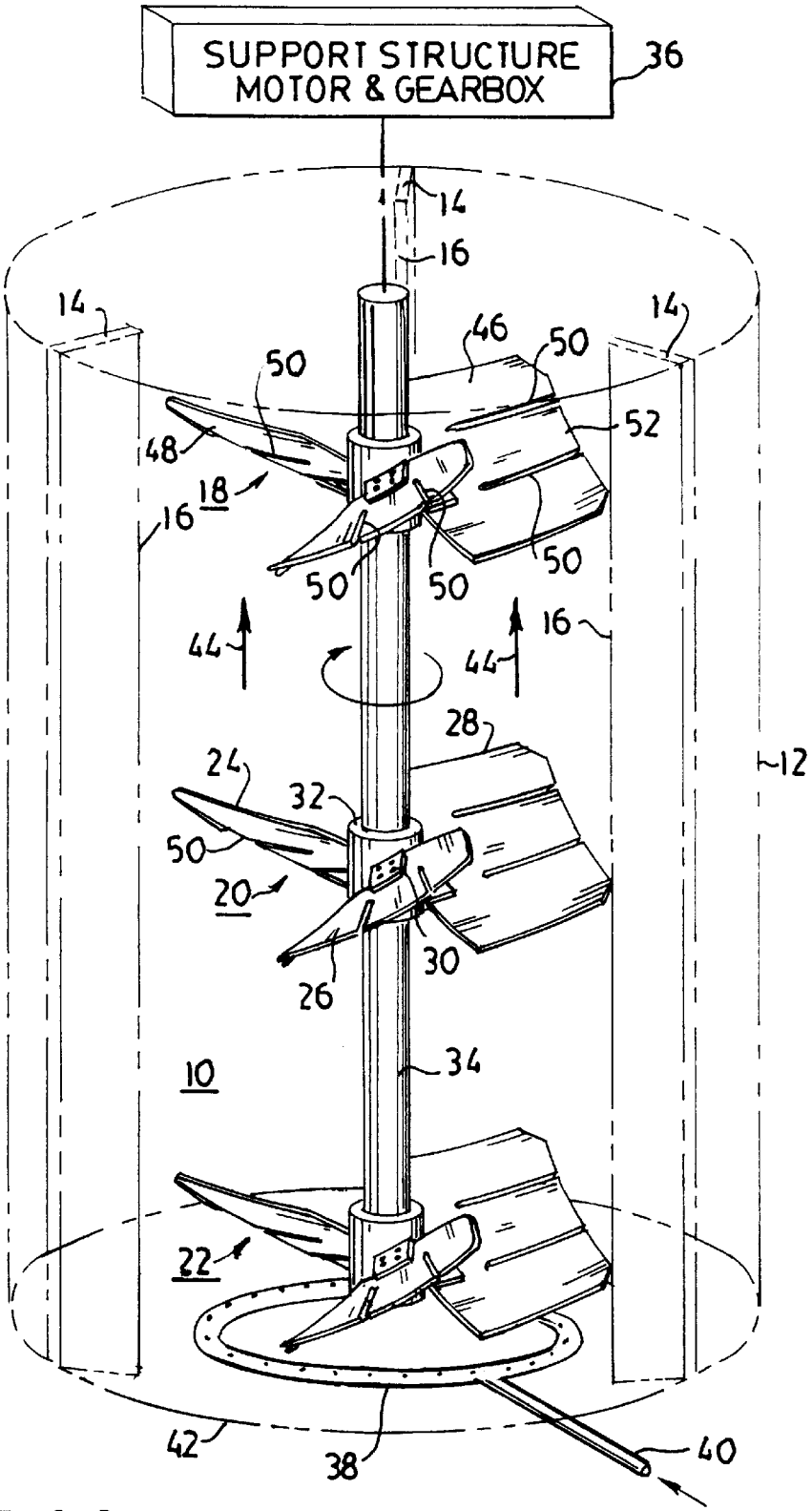
FIG. 1 is a perspective view of an impeller system of up pumping impellers, which is adapted to be used in a gas/liquid mass transfer or stirred reactor system. The tank and baffles are shown in phantom and the support for the impeller system and the motor and gear box are illustrated schematically. The blades are slotted to enhance the efficiency of mass transfer, without significantly reducing fluid pumping efficiency.

Referring to FIG. 1, there is shown a mixing impeller system 10 in a tank 12 having baffles 14 which provide a zone of a diameter between their inner edges 16 for the impellers 18, 20 and 22 of the system 10. The impellers are essentially identical and each has three blades 24, 26 and 28 attached to ears 30 of hubs 32. The hubs may be keyed or otherwise attached to a shaft 34. The shaft attaches to a support structure and is driven by a motor and gearbox as is conventional. The support structure, motor and gearbox are, therefore, shown schematically at 36. A sparge ring 38 for introducing a fluid to be dispersed and mass transferred to the fluid in the tank 12 is disposed below the lowermost impeller 22. The fluid, in this case a gas, is delivered via a pipe 40 into the sparge ring and is released through holes in the ring. The sparge ring is close to the bottom 42 of the tank 12 and may be generally concentric with the shaft and have a diameter approximately 80% of the diameter of the impellers. The impellers are of the A320 type as described in U.S. Pat. No. 5,046,245 to Ronald J. Weetman and Richard A. Howk, issued Sep. 10, 1991 to which reference may be had for the details of the construction thereof. The impellers shown in FIG. 1 are adapted for uppumping operation. That is, they produce axial flow in a direction indicated by the arrows 44 toward the surface of the liquid in the tank, which flow is generally along the axis of rotation of the shaft 34. The blades are curved and twisted plates having concave, pressure sides 46 and convex, suction sides 48. The blades have passways provided by slots 50 extending from the tips 52 generally radially inwards towards the inner ends of the blades at the hubs. The slots extend approximately 70% of the blade radius to the tips, where the suction is greatest due to the highest velocity of the blades being at the tips.

The flow paths extend from the suction side. See FIGS. 3A–C and 4A–C. The slots disrupt the flow and prevent the accumulation of gas or coalescence in the case of liquids having viscosity greater than the liquid in the tank. Some gas will of course go by the tips. However, the flow across the suction sides is disrupted. What is prevented is buildup on the impeller of the gas, especially in high viscosity fluids, to a point where it has enough buoyancy to separate from the blade and produce a large bubble in the liquid continuum. The dispersion of fine bubbles that create large surface areas for effective mass transfer can therefore be inhibited by solid blades. The large bubbles also disturb the flow pattern in the tank and create mechanical forces which can cause wobble of the impeller system and even mechanical failures.

Figure 2:
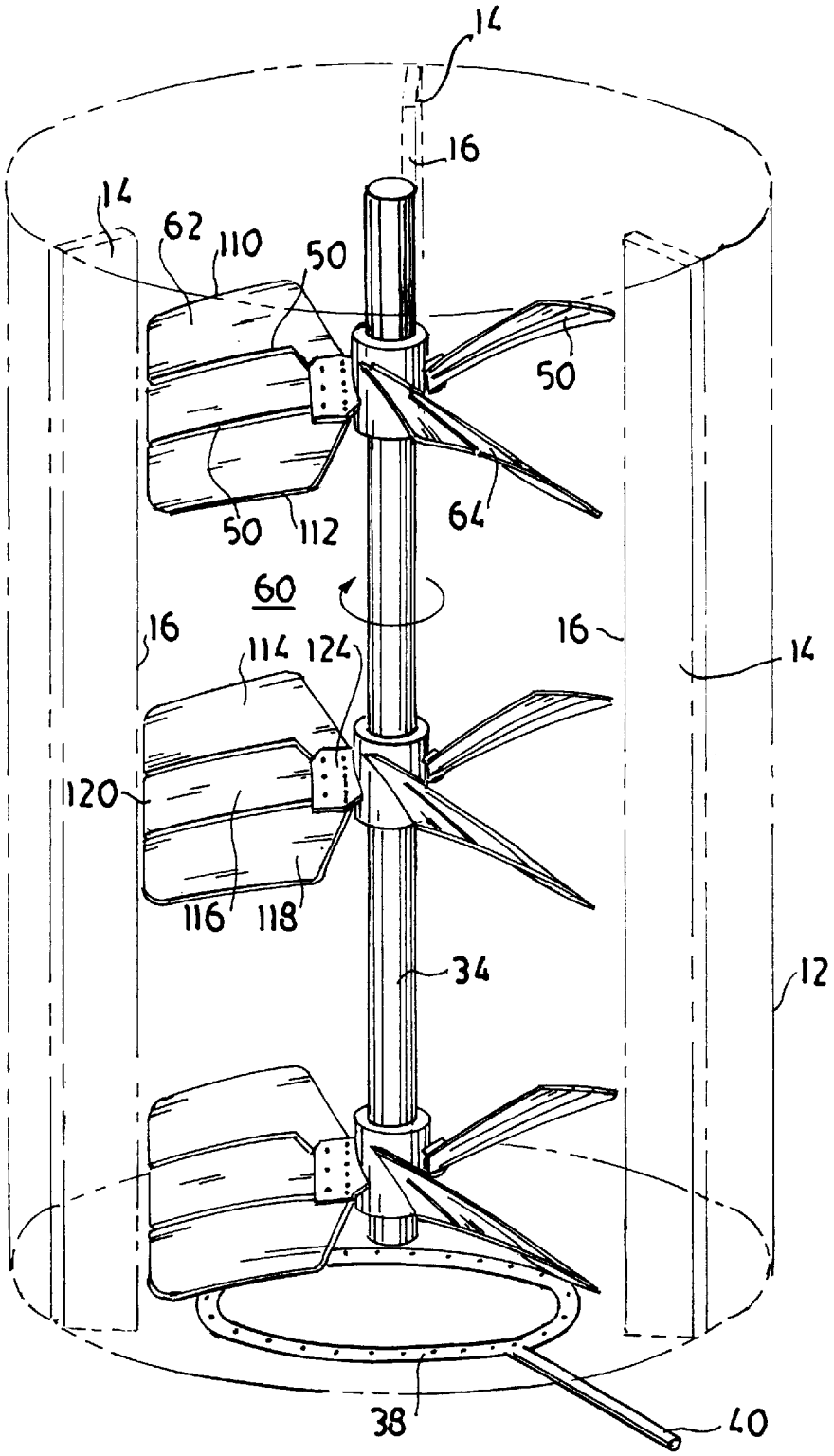
FIG. 2 is a perspective view of a down pumping impeller system, also adapted for mass transfer, having multi-segment impeller blades with the tank and baffles shown schematically and with support structure, motor, and gear drive for the impeller system omitted to simplify the illustration.
Figure 4A:
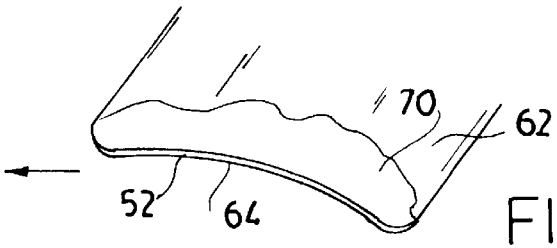
FIGS. 4A, B, and C are perspective views of the tip region of the down pumping blades, much like in FIGS. 3A, B, and C for the case where the blades are not segmented, have two segments and three segments, which illustrates the effect the gaps between the segments on the formation of bubbles located on the suction sides of the blades in the tip regions, thereof.
Figure 4B:
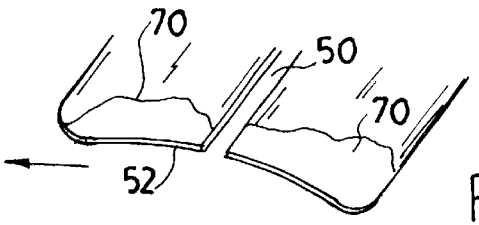
Figure 4C:
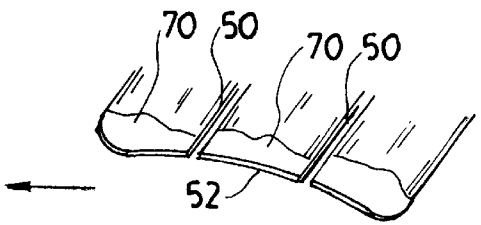
Figure 3A:
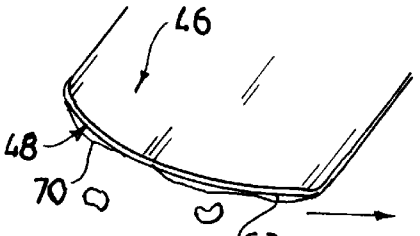
FIGS. 3A, B, and C are fragmentary, perspective views illustrating the tip region of the up pumping impeller blades and showing the effects of the slots on bubble formation on the suction sides of the blades.
Figure 3B:
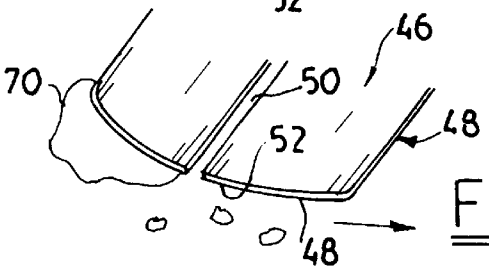
Figure 3C:
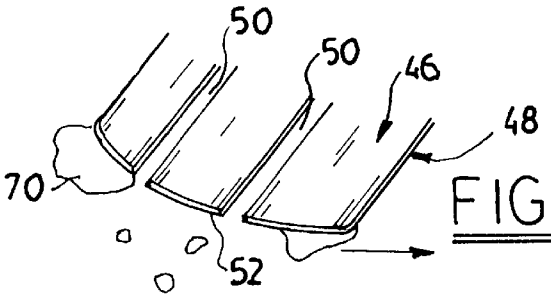

The effect is even more serious for downpumping impeller systems, such as it the case with the impeller system 60 shown in FIG. 2. There the bubbles grow on the upper suction (convex) sides 62 of the blades. These bubbles rise in the opposite direction to the main flow, when the impeller is downpumping. In either case (up or down pumping), the bubbles form on the suction sides 62 of the blades. When the bubbles surround the blades, axial flow stops, and the gas is dispersed radially. This reduces the power draw from the motor. The gas flow must be reduced to prevent flooding, thus the mass transfer efficiency and gas handling capacity of the system is decreased. The flow paths through the slots 50 reduce the tendency for the bubbles to grow and increase the mass transfer efficiency and capacity. The bubbles in the uppumping case are shown at 70 (FIG. 3) and are smaller for three slots than for one. In the downpumping case, the reduction of the size of the bubbles is even more evident than for the uppumping case as shown in FIGS. 4A, B and C; this reduction being obtained by virtue of the slots 50.

Figure 5:
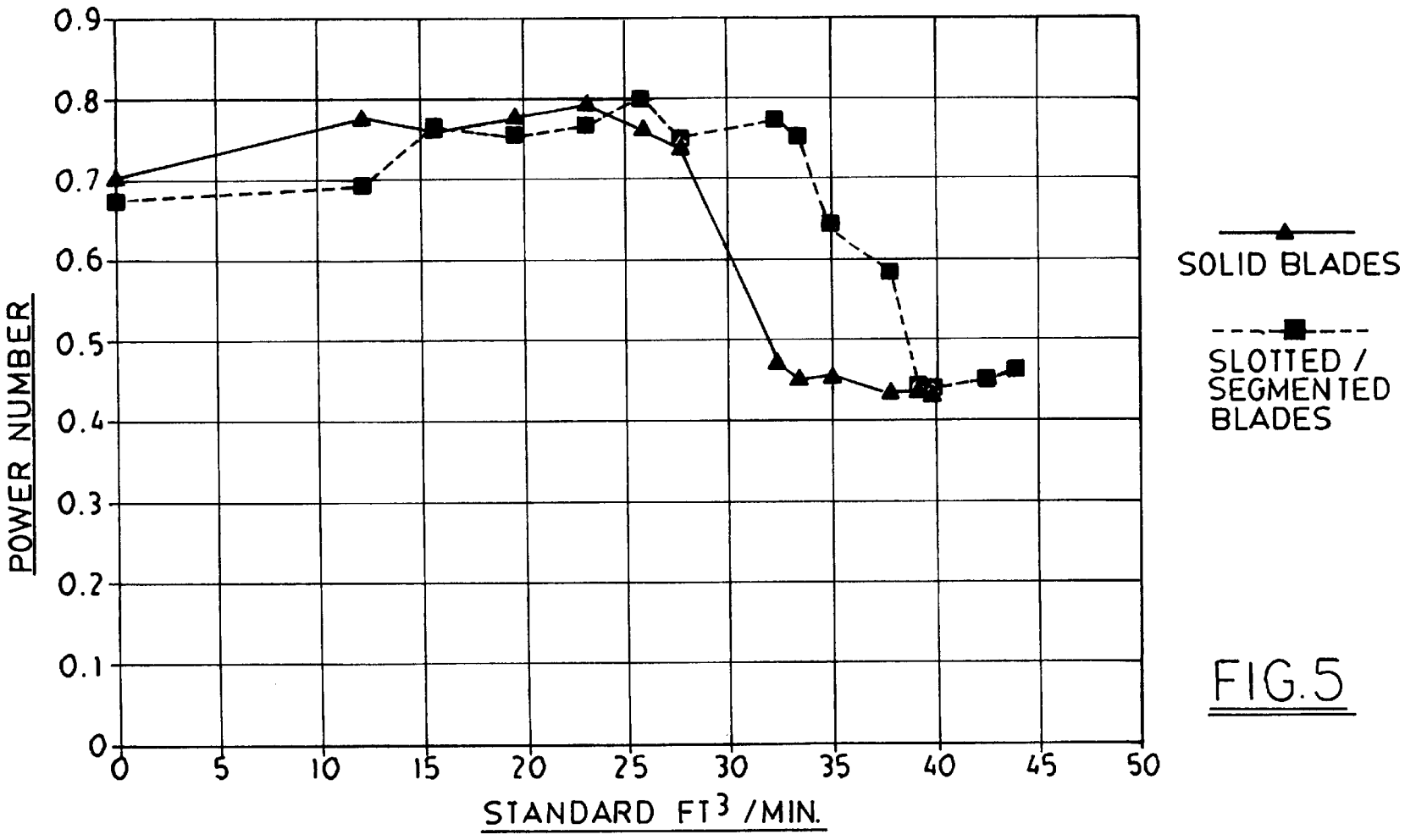
FIG. 5 is a plot illustrating the efficiency of a slotted or segmented blade impeller system in terms of the gas flow in standard cubic feet per minute into the tank for different power numbers which are a function of the power used to drive the impeller system. The solid curve shows the case where the blades are solid while the dash line curve show the case where the blades are segmented or slotted.

The improvement in dispersion and mass transfer is evident from FIG. 5 where slotted blades are compared with segmented blades of a down pumping impeller system. It will be noted that the power number decreases for higher flow rates in terms of standard cubic feet per minute of gas. By standard is meant standard pressure and temperature (room and atmospheric). The power number, as is known in the art, is the ratio of power, which drives the impeller system, to the product of the density of the fluid in the tank, the speed of the impeller cubed and the impeller diameter to the fifth power. The reduction of the power number illustrates the onset of flooding and flooding at approximately 27 cubic feet per minute, in the case of the solid blades, while the slotted or segmented blades do not flood until the gas flow reaches about 40 cubic feet per minute. Another advantage is that the gas transfer capability of a four-bladed solid impeller can be obtained with a three-bladed slotted or segmented impeller. Thus, an impeller of lower weight and requiring less power to operate (an impeller with fewer blades) can provide the same mass transfer capability as an impeller having more blades.

Figure 8:
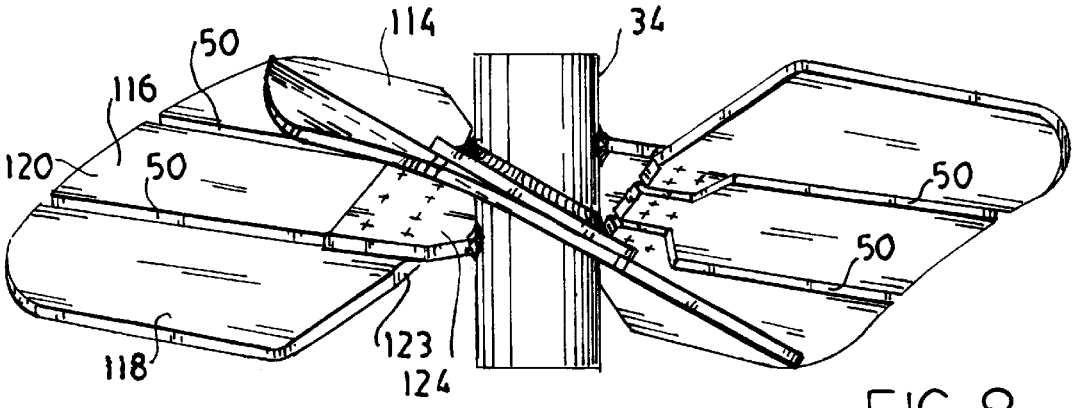
FIG. 8 is a side view of the impeller shown in FIG. 7.

It will be observed that the slots extend generally perpendicular to the suction side and through the pressure side of the blades. This construction is shown in the case of the segmented blade impellers in FIG. 8. In the case of the impellers which are especially adapted for mass transfer processes, such impellers have blades made of plates. Where the blades are thicker airfoils, the slots are generally perpendicular to the chord of the blade. Such slots, rather than enhancing flow over the pressure side of the blade and preventing separation, disrupt the flow so as to prevent the growth of bubbles and improve dispersion and mass transfer by providing finer, smaller size bubbles which are pumped axially in the tank. Thus, the pathways increase mass transfer, even at the same introduction rate of the gas or fluid to be dispersed and mass transferred. The slots cause flow disturbance, which create turbulence and break bubbles. Thus, the mass transfer coefficient, kLa is increased in mixing impeller systems incorporating the improved blades provided by the invention.

Figure 9:
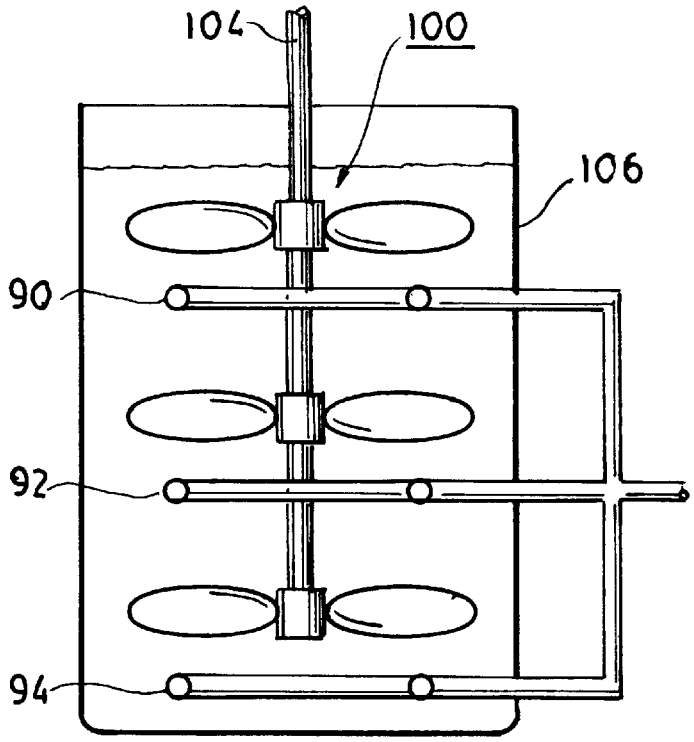
FIGS. 9 and 10 are schematic views of stirred reactor or sparging systems with different sparge arrangements.
Figure 10:
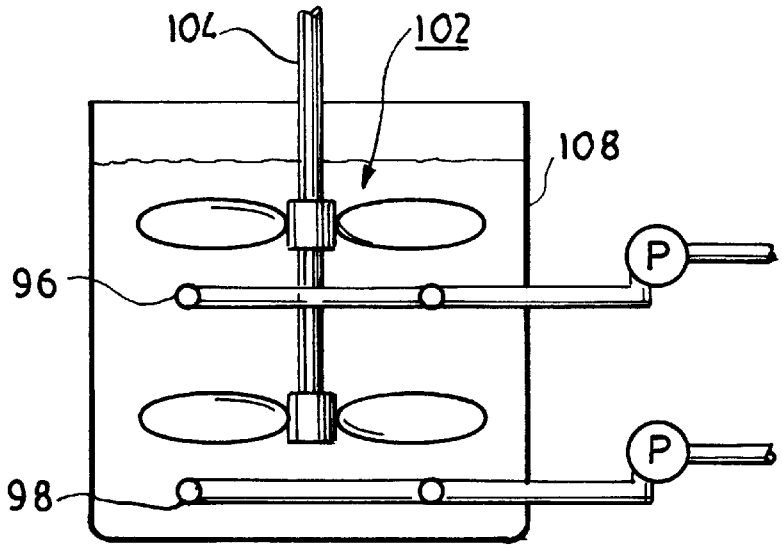

The efficiency of sparging systems may also be enhanced by sparging the gas or other fluid to be dispersed and mass transferred at different sparging stages. Three sparging stages 90, 92 and 94 are shown in FIG. 9, and two sparging stages 96 and 98 are shown in FIG. 10. These figures also show multi-impeller axial flow impeller systems 100 and 102. The sparging stages are provided by sparge rings which are generally concentric with the shafts 104 of the impeller systems and have diameters approximately 80% of the diameters of the impellers thereof. One sparge stage 94 and 98 is located between the bottom most impeller of the system and the bottom of the tank, which is illustrated at 106 in the case of the system of FIG. 9 and 108 in the case of the system of FIG. 10. The other sparging ring 96 in FIG. 10 is disposed in the space between the impellers of the mixing impeller system 102. In both cases, the gas is released in the axial flow discharged or pumped by the impellers of the system. The sparge rings are at different heights, thus less pressure is required to introduce the gas or other fluid depending upon how far from the bottom of the tank the system is located. And different amounts of pressurization, in any case above that required to exceed the head of the liquid at the sparge rings, need be applied to introduce or pump the fluid to the sparge rings. In any event, releasing the fluid to be sparged in stages equalizes the distribution of the fluid and enhances the dispersion of the gas and efficiency of the dispersing and mass transfer process in the tanks 106 and 108.

Impeller blades made of segments are shown in FIGS. 2, 6, 7 and 8. FIG. 2 illustrates that the diameter of the impellers is approximately equal to the diameter of the region defined between the inner edges of the baffles. There is therefore, very little space in the tank for the impeller system, which makes the impeller system difficult to install, to change blades or to retrofit. The width of the blades as measured between the leading and trailing edges 110 and 112 in the illustrated case is approximately one-half the impeller diameter. This is typical of large blades which are difficult to handle. Many tanks of mixing reactors have manways which are smaller than the width of the blades. These tanks may be essentially closed so that there is no entry except through the manway. The segmented blade assemblies provided by the invention enable large blades to be used. Such large blades are especially desirable for axial flow impellers since they are needed to obtain the flow necessary to stir the medium in the tank all the way to the bottom of the tank and thereby to provide mixing from the top to the bottom of the tank. Typically, large impellers have diameters of above 12 feet. The segmented impeller provided by the invention may have a blade width one-half the impeller diameter as noted above. However, with three segments, the width of each segment can be about one-third of one-half the diameter of the impeller or 17% of the diameter. The segments extend the application of large axial flow impellers to large tanks, and especially where the diameter of the impeller and the diameter of the tank or the region in the tank where rotation of the impeller occurs, is limited.

Each blade is shown with three segments; 114, 116 and 118. Of course, there may be fewer or more segments. The segments have edges which extend generally radially inward from the tip ends 120 of the blades to the hub ends. The edges may be separated to provide gaps which afford flow passages and affect bubble size growth as was explained, in connection with FIGS. 3A, B and C as well as 4*a, b* and *c* in fluid dispersion and mass transfer applications.

The blades are attached to ears 124, which are welded to collars providing hubs 126, which are keyed or otherwise attached to the shaft 34. The welds of the ears to the hubs are shown at 128. Other attachment of the ears to the hubs may be used.

The inner ends 123 are defined by inner ends 130, 132 and 134 of the segments 114, 116 and 118 which are in overlapping relationship. Each segment may be independently attached, as by bolts 136 or welding to the ears 124. The attachment leaves gaps which extend from the tips 120 inwardly of the blades. These gaps have separations, which provides the passages, which disrupt the flow over the suction sides of the blades and enhance the gas dispersion and mass transfer characteristics of the system by reducing bubble size as explained above. Typically, the width of the gaps as measured between the leading edge 110 and trailing edge 112 of the blades may be typically one percent of the impeller diameter. A suitable range may be 0.005 to 0.015 times the impeller diameter.

If the process carried out in the tank does not involve gas or fluid dispersion, then the segments can be butted together. The segmented blades may be assembled in place in the tank and readily handled individually prior to and during assembly.

Figure 6A:
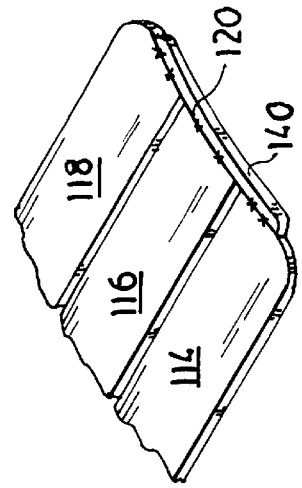
FIG. 6A is a perspective view of the tip region of the blade shown in FIG. 6, but with a blade strengthening strip at the tip.
Figure 6:
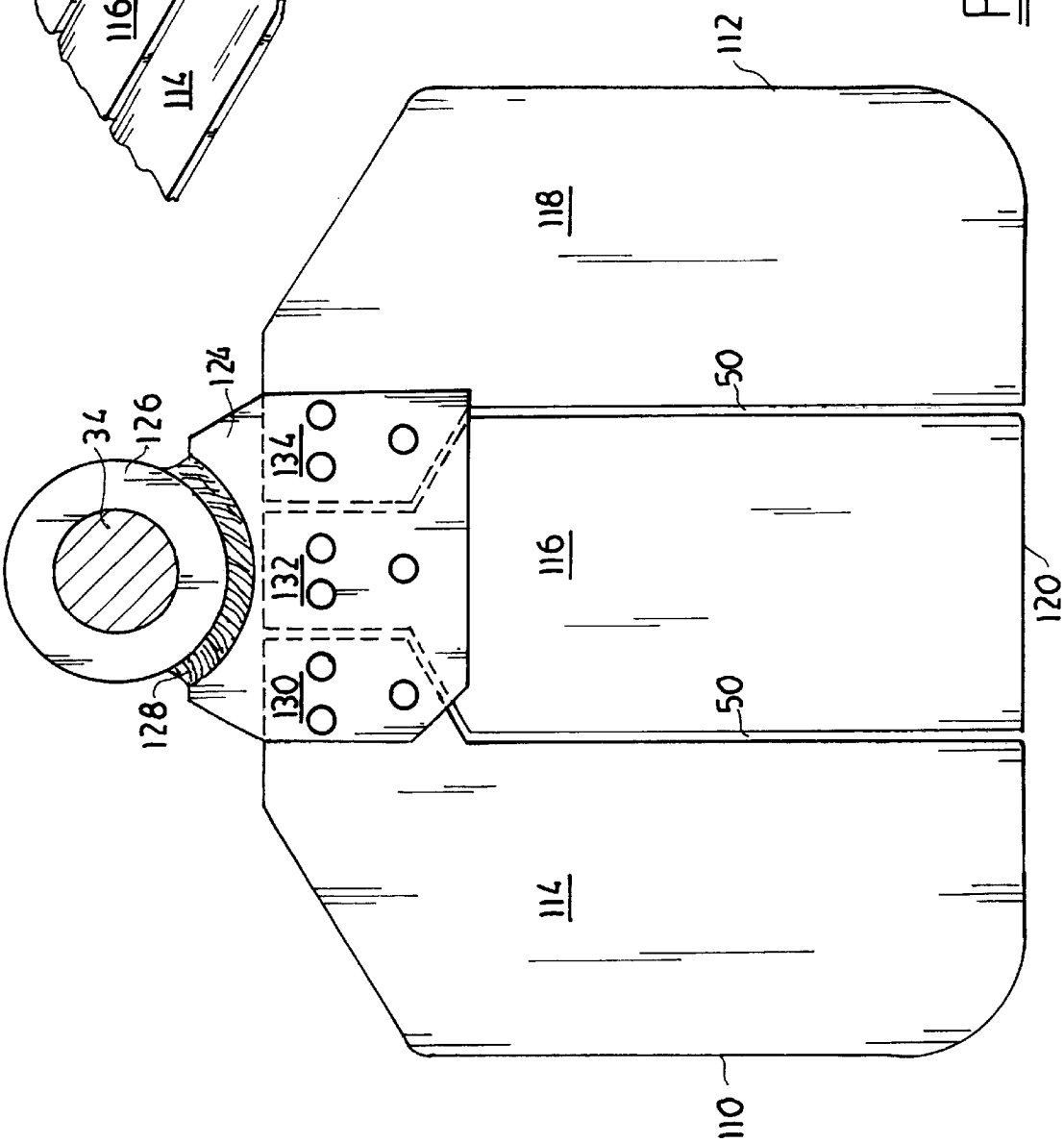
FIG. 6 is a plan view illustrating the layout of a segmented blade and hub, but omitting the bolts fastening the segments to the hub.
Figure 7:
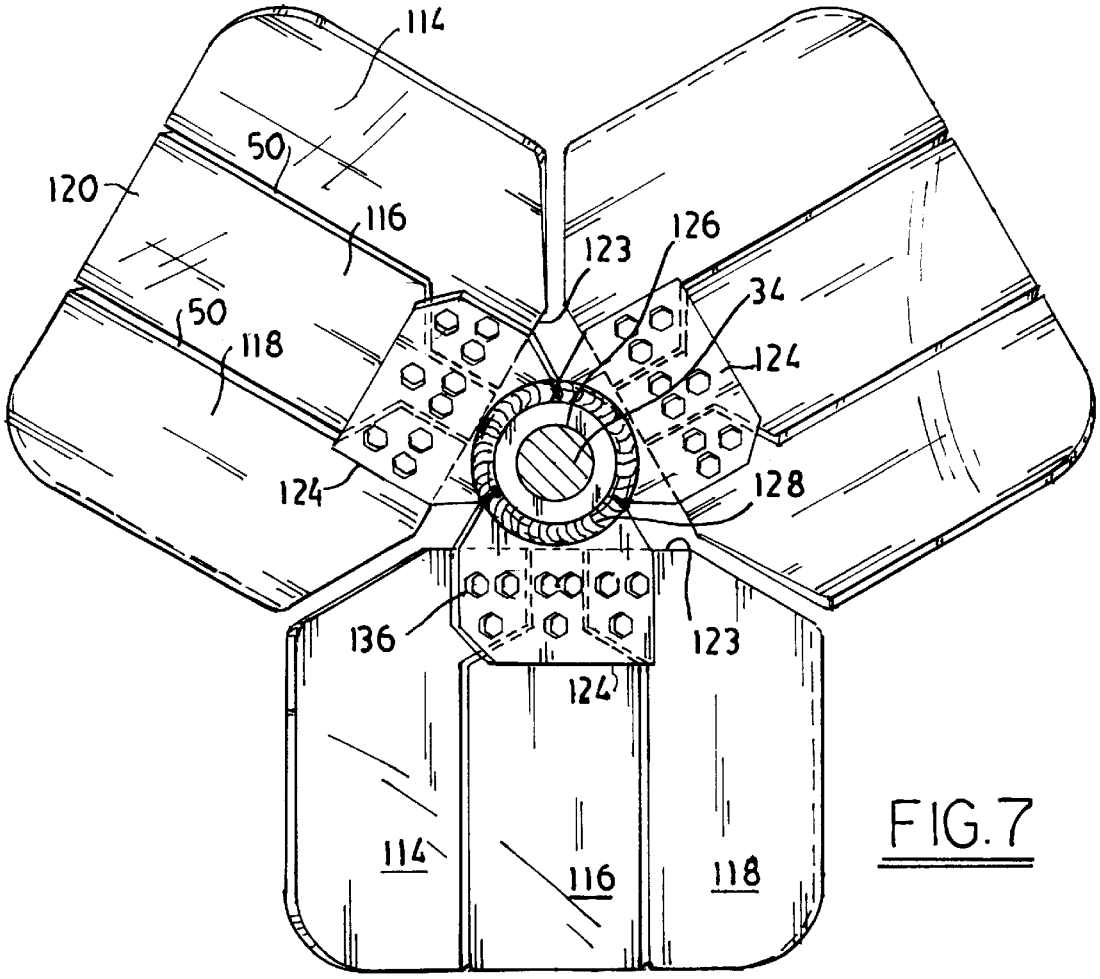
FIG. 7 is a plan view of a three bladed multi-segmented impeller.

As shown in FIG. 6*a,* the blades may be strengthened by attaching, as by welding, a reinforcement bar or strip 140 across the tips 120 of the segments 114, 116 and 118.

From the foregoing description, it will be apparent that there has been provided improved impeller systems having advantages of ease of handling and improving the process in which they are used. Variations and modifications in the herein described impeller systems, within the scope of the invention, will undoubtedly suggest themselves to those skilled in the art. Accordingly, the foregoing description should be taken as illustrative and not in a limiting sense.

What is claimed is:

1. A method of mass transfer between a first fluid and a second fluid that either one of has a same and a different density or viscosity from said first fluid, comprising:

releasing said second fluid into a tank containing said first fluid, agitating said fluids with an axial flow impeller having a plurality of blades which have suction and pressure sides disposed successively in a direction of axial flow and which also have radially inner and outer ends and tips at said radially outward ends thereof, and reducing a size of bubbles of said second fluid over the suction sides of said blades by providing flow paths for said second fluid through said blades, which flow paths extend inwardly of said blades substantially all the way from said outer ends to said inner ends and are generally perpendicular to said suction sides.

2. The method according to claim 1 wherein said step of providing said flow paths is carried out by slotting said blades.

3. The method according to claim 2 wherein said slotting step is carried out so that said slots have widths in a range from 0.005 to 0.015 times a diameter of said impeller or about equal to a thickness of said blades.

4. The method according to claim 1 wherein said step of providing said flow paths is carried out by assembling said blades from segments to leave gaps providing said flow paths between said segments.

5. The method according to claim 4 wherein said assembling step is carried out so the at said slots have widths in a range from 0.005 to 0.015 times a diameter of said impeller or a bout equal to a thickness of said blades.

6. The method according to claim 4 wherein said assembling step is carried out in said tank when a diameter of said impeller is equal to a diameter of said tank or a zone in said tank where said impeller rotates is within a predetermined percentage of the impeller diameter or where access to said tank is limited by a manway to a size less than half the diameter of said impeller.

7. The method according to claim 1 wherein said providing step is carried out leaving said suction and pressure sides of said blades as smooth continuous surfaces, except for said flow paths.

8. The method according to claim 1 wherein said first fluid is a liquid and said second fluid is a gas.

9. The method of claim 1 where said substantially all the way is about 70 percent of a radius of said blades.

10. An impeller system for carrying out mass transfer between a first fluid and a second fluid different from said first fluid, in a tank in which said fluids are contained, said system comprising:

at least one axial flow impeller on a shaft with which said impeller is driven so as to pump fluid in a direction axially of said shaft, said impeller having blades with suction sides and pressure sides, said pressure sides being spaced by a thickness of said blades away from said suction sides in a direction of an axial flow, and at least one opening disposed in each of said blades and which extends inwardly of said blades substantially all the way from said outer ends to said inner ends, said openings which disrupt the axial flow over substantially all of the suction sides of said blades thereby preventing formation of bubbles in said second fluid on said suction sides which reduce the axial flow provide ed by said impeller.

11. The impeller system according to claim 10 wherein said openings are provided by slots extending inwardly from tips of the blades.

12. The impeller system according to claim 11 wherein a width of said slots is from 0.005 to 0.015 times an impeller diameter or about equal to the thickness of said blades.

13. The impeller of claim 11 wherein said substantially all the way is about 70 percent of a radius of said blades from said tips.

14. The impeller system according to claim 10 wherein said blades are an assembly of segments attached to said shaft and extending generally radially outward therefrom to tips of said blades, said openings being provided by gaps between said segments which extend generally radially inward from said tips.

15. The impeller system according to claim 14 wherein a size of said gaps is in a range from 0.005 to 0.015 times an impeller diameter or about the same as the thickness of said blades.

16. A method of mass transfer between a first fluid and a second fluid that either one of has a same and a different density or viscosity from said first fluid, comprising:

releasing said second fluid into a tank containing said first fluid, agitating said fluids with an axial flow impeller having a plurality of blades which have suction and pressure sides disposed successively in a direction of axial flow and which also have tips at radially outward ends thereof, reducing a size of bubbles of said second fluid over the suction sides of said blades by providing flow paths for said second fluid through said blades which extend from said radially outward ends about 70 percent of a radius of said blades and are generally perpendicular to said suction sides.

17. An impeller system for carrying out mass transfer between a first fluid and a second fluid different from said first fluid, in a tank in which said fluids are contained, said system comprising:

at least one axial flow impeller on a shaft with which said impeller is driven so as to pump fluid in a direction axially of said shaft, said impeller having blades with suction sides and pressure sides, said pressure sides being spaced by a thickness of said blades away from said suction sides in a direction of said axial flow, and means for disrupting the flow of said fluid over about 70 percent of a radius of said blades from radially outward ends of said blades thereof.

* * * * *